US006176054B1

(12) United States Patent
Allen et al.

(10) Patent No.: US 6,176,054 B1
(45) Date of Patent: Jan. 23, 2001

(54) DEMOUNTABLE WALL SYSTEM HAVING A SEAMLESS COVERED WALL

(76) Inventors: William C. Allen, 4405 S. Ridge, Fuquay-Varina, NC (US) 27526; Loy C. Allen, 1508 Kildaire Farm Rd., Cary, NC (US) 27511

( * ) Notice: Under 35 U.S.C. 154(b), the term of this patent shall be extended for 0 days.

(21) Appl. No.: 09/274,035

(22) Filed: Mar. 22, 1999

(51) Int. Cl.[7] ..... E04B 2/02

(52) U.S. Cl. ..... 52/272; 52/238.1; 52/241; 52/489.1; 52/469; 52/471

(58) Field of Search ..... 52/272, 238.1, 52/241, 489.1, 489.2, 469, 468, 471, 313

(56) References Cited

U.S. PATENT DOCUMENTS

| | | | | |
|---|---|---|---|---|
| 2,063,010 | * | 12/1936 | Balduf | 52/241 |
| 2,232,762 | * | 2/1941 | Batcheller | 52/468 |
| 2,810,166 | * | 10/1957 | Nelsson | 52/241 |
| 3,087,586 | * | 4/1963 | Gray | 52/241 |
| 3,320,710 | * | 5/1967 | Byssing | 52/241 |
| 3,369,831 | * | 2/1968 | Mckinnie | 52/469 |
| 3,868,802 | * | 3/1975 | Schubach | 52/468 X |
| 4,333,286 | * | 6/1982 | Weinar | 52/489.2 X |
| 5,590,502 | * | 1/1997 | Wendt | 52/489.2 |

FOREIGN PATENT DOCUMENTS

| | | | | |
|---|---|---|---|---|
| 667488 | * | 6/1929 | (FR) | 52/469 |

* cited by examiner

*Primary Examiner*—Carl D. Friedman
*Assistant Examiner*—Phi Dieu Tran A
(74) *Attorney, Agent, or Firm*—Coats & Bennett, PLLC

(57) ABSTRACT

A demountable wall system that is adapted to be interposed between a floor and ceiling structure and including a series of wall panels that include a continuous and seamless wall covering. More particularly, the demountable wall system includes a floor railing disposed adjacent to the floor structure and a ceiling railing detachably connected to the ceiling structure. Longitudinally spaced between the ceiling and floor railings are a series of upright wall studs. Secured generally between the ceiling and floor railings and connected to the wall studs is a series of wall panels that are disposed edge to edge to form a continuous wall along one or both sides of the demountable wall system. Each wall panel includes a face area and there is applied to the central portion of the face area a wall covering. However, this pre-applied wall covering is not applied to the entire face. Outer areas on each side of the pre-applied wall covering are left uncovered. Once mounted within the demountable wall system, a wall covering filler strip is extended vertically over the interface or seam formed between the respective wall panels. This filler strip is spread outwardly so as to also cover the adjacent uncovered areas of the wall panels. Thus, once the filler strips have been applied, the wall formed by the respective wall panels includes a continuous and seamless wall covering along a substantial length of the demountable wall system.

7 Claims, 4 Drawing Sheets

DEMOUNTABLE WALL SYSTEM HAVING A SEAMLESS COVERED WALL

FIELD OF THE INVENTION

The present invention relates to commercial wall systems that are erected and installed between floor and ceiling structures, and more particularly to a demountable wall system that can be moved from one location to another within a building and which includes a seamless wall structure.

BACKGROUND OF THE INVENTION

Commercial wall systems are widely used today in a variety of commercial buildings. Typically these commercial wall systems are installed between floor and ceiling structures. Their acceptance may be in large part due to a number of factors. But it is clear that these types of commercial wall systems are economical, practical and yield a quality finished wall structure. Moreover, these wall systems are typically built from standard components using standard assembly procedures and techniques. Consequently, the walls are built with precision and as a result their overall quality tends to be at a very high level throughout. Also, commercial wall systems can be very versatile and adaptable. It is known to provide these commercial wall systems in the form of a demountable structure that can be easily moved from one location to another location in the same building.

Typically these commercial wall systems are made up of a frame structure that is designed to receive and retain a series of wall panels that are generally connected within the wall structure edge to edge. Although the wall panels may be pre-covered with some form of a wall covering, they do have one draw back or shortcoming in that the edge-to-edge construction results in a seam at certain intervals along the wall. These seams are often viewed negatively especially when it comes to certain commercial settings, like for example Class A office space.

Therefore, there has been and continues to be a need for a commercial wall system that is both demountable and which includes a seamless and continuous wall structure.

SUMMARY OF THE INVENTION

The present invention entails a demountable wall system having a series of seamless wall panels that are adapted to be mounted between a ceiling and a floor structure and which is adapted to be readily movable from one location to another location between the same floor and ceiling structures. The demountable wall system includes a floor railing disposed adjacent the floor and an elongated ceiling railing detachably connected to the ceiling structure. A series of spaced apart upright wall studs are interconnected between the floor and ceiling railings. Secured along one or both sides of the demountable system is a series of wall panels. Each wall panel includes a face area, back, opposed side edges, and a pre-applied exterior wall covering secured to a central portion of the face area so as to effectively define a pair of uncovered areas on opposite sides of the pre-applied wall covering. Panels are joined side edge to side edge and this creates a seam or interface between respective wall panels. To cover the seams the demountable wall system of the present invention includes a wall covering seam filler strip that is designed to be applied down the seam formed at the interface. Further, the same filler strip is effectively applied to the uncovered areas or strips that flank the seam that have been left uncovered as a result of the fact that the pre-applied wall covering only covers a generally central portion of the face of the wall panel. Thus in the end, there is provided a fully demountable commercial wall system wherein the wall panels are assembled in such a fashion that a continuous and seamless wall covering appears across a substantial distance along the wall system.

In another embodiment of the present invention, the demountable wall system of the present invention is erected according to a particular method or process. In this regard, the individual walls panels are formed with the pre-applied central wall covering before being mounted into the frame structure of the wall system. In this case, the wall panels still include uncovered areas that lie adjacent the respective side edges and outwardly of the pre-applied central wall covering. These prefabricated wall panels are first inserted into the frame of the wall system. Once inserted edge to edge and securely fashioned generally between the ceiling railing and the floor railing, there is formed an exposed seam at the interface of the side edges of the respective wall panels. But once erected, then the seam can be covered by the wall covering filler strip described above. Essentially in an embodiment where the created seams run vertically, a strip of the seam filler is prepared and is pressed over the seam and effectively adhered over the seam and the adjacent uncovered areas of the wall panels. The width of the wall covering filler strip is particularly cut or pre-manufactured so as to match and fit precisely between the two spaced apart pre-applied wall coverings of the adjacent two wall panels.

It is therefore an object of the present invention to provide a demountable wall system that includes a seamless outer wall structure.

A further object of the present invention is to provide a method or process of erecting and assembling a demountable wall structure in such a fashion as to create a seamless and continuous outer wall along one or both sides the wall structure.

Other objects and advantages of the present invention will become apparent and obvious from a study of the following description and the accompanying drawings which are merely illustrative of such invention.

DESCRIPTION OF THE INVENTION

Figure 1:
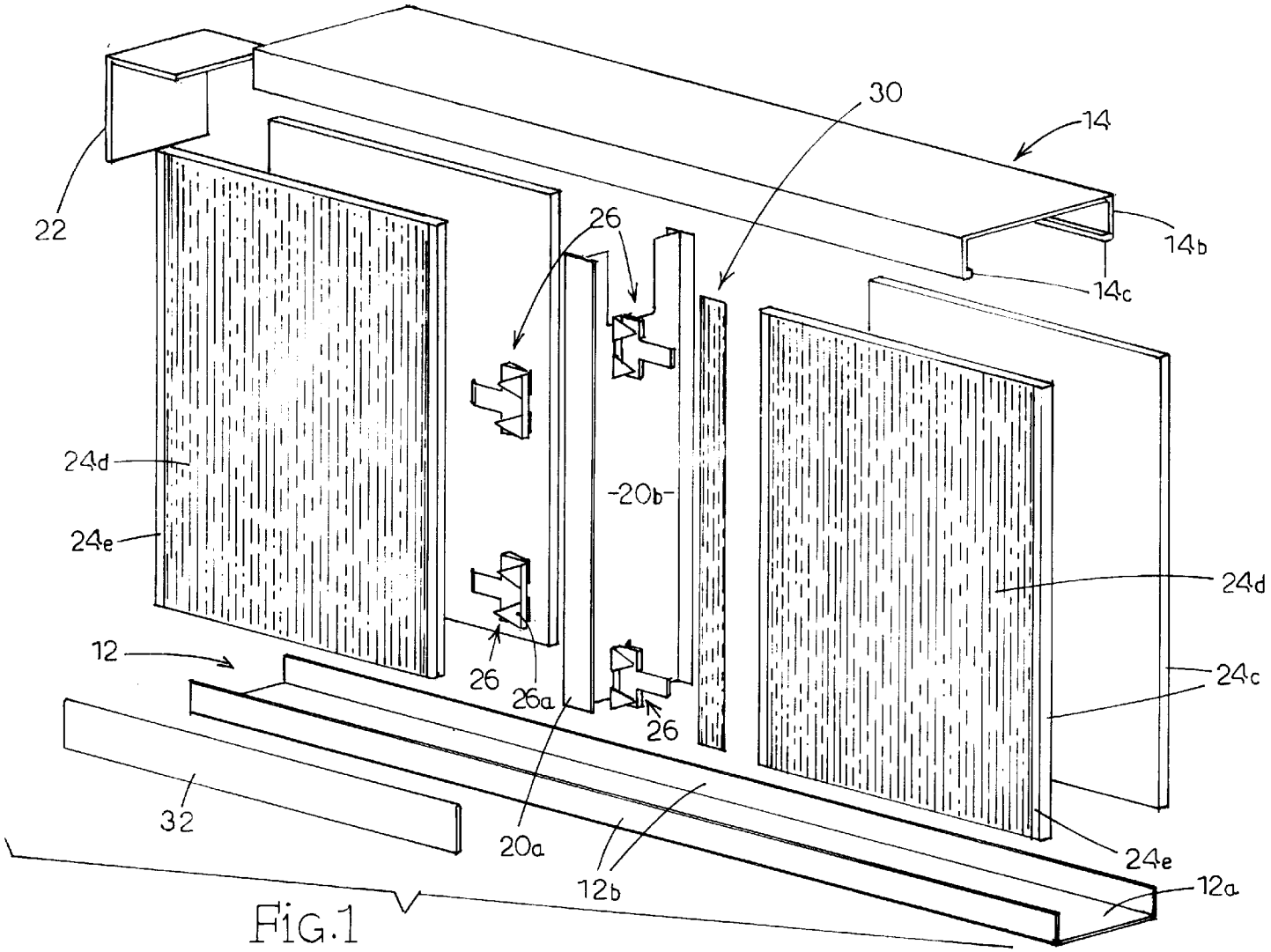
FIG. 1 is a perspective and exploded view showing various components of the demountable system of the present invention.

With further reference to the drawings, the demountable wall system of the present invention is shown therein and indicated generally by the numeral 10. As will be discussed, the demountable wall system 10 is designed to be erected and secured between a floor structure 16 and a ceiling structure 18.

Viewing the demountable wall system 10 in some detail, it is seen that the same includes a floor channel 12. The floor channel 12 is an elongated u-shaped structure that is typically constructed of metal or other suitable materials. Because of its generally u-shape it includes a base 12*a* that typically rests adjacent the floor structure 16 and a pair of spaced apart upstanding legs 12*b*.

Figure 2:
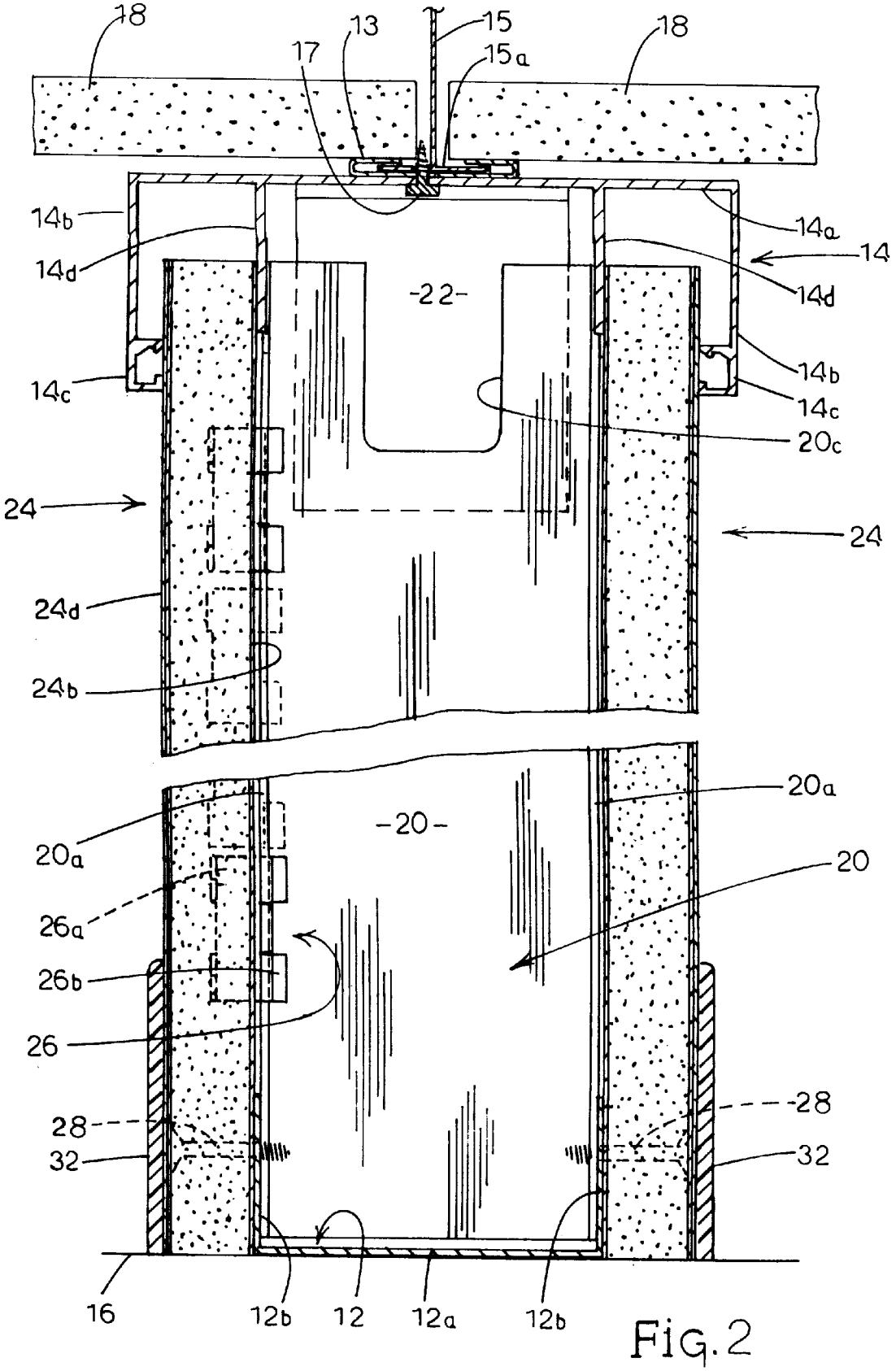
FIG. 2 is a transverse sectional view through the demountable wall system of the present invention illustrating various component structures of the same.

Disposed over the floor channel 12 and generally vertically aligned therewith is an elongated ceiling railing indicated generally by the numeral 14. The ceiling railing 14 assumes a generally inverted u-shape configuration and as such includes a flat ceiling strip 14*a* that is designed to rest adjacent the ceiling structure 18. Depending downwardly from the ceiling strip 14*a* is a pair of outer spaced apart legs 14*b*. Formed on the terminal ends of the legs 14*b* is a pair of contact rails 14*c* that include an elongated opening or cavity formed therein. In addition, the ceiling railing 14 includes a pair of inner spaced apart Ranges 14*d* that depend downwardly from a central area of the ceiling strip 14*a*. As seen in FIG. 2, there is a space defined between the outer legs 14*b* and the respective inner flanges 14*d*. This space is provided such that the wall panels, which will be subsequently discussed, can be fitted upwardly between the legs 14*b* and flanges 14*d* that project downwardly from the ceiling strip 14*a*.

The ceiling railing 14 is designed to be detachably connected below the ceiling structure 18 such that the entire demountable wall system 10 can be moved from one location to another location within the same building. In the embodiment disclosed herein, the demountable wall system 10 is adapted to be suspended or connected below an acoustical tile ceiling structure 18. To support the acoustical ceiling panels 18 and the demountable wall system 10, there is provided an acoustical ceiling grid that includes a series of spaced apart T-shaped hangers 15 that extend downwardly between respective acoustical ceilings tiles 18. Note in FIG. 2 where the T-shape hangers include a lower transverse portion 15*a*. An elongated connector run 13 is disposed around the transverse portions 15*a* of the hangers 15. Thus the transverse run 13 underlies and supports the acoustical ceiling tiles 18. A series of screws 17 are extended through the ceiling strip 14*a* of the demountable wall system 10 and secured through both the connector run 13 and the transverse portion 15*a* of the respective hangers. This effectively secures the demountable wall system 10 to the ceiling structure of a building. Although the ceiling structure described herein and shown in FIG. 2 is of the acoustical ceiling tile type, it is appreciated that other types of ceiling structures can be utilized in conjunction with the present invention.

To impart rigidity to the entire demountable wall system 10 and to assist in suspending wall panels, to be discussed hereafter, there is provided a series of wall studs 20. These wall studs 20 are longitudinally spaced along the length of the demountable wall system 10 and are typically constructed of metal or other suitable materials. Wall studs 20 assume a generally H or I-beam type configuration as they include a pair of side rails 20*a* and a center section 20*b*. In the embodiment illustrated herein, as shown in FIG. 2, the wall studs can be provided with an upper utility cutout 20*c* that enables utility wires and other utilities to be effectively strung or passed through the respective wall studs 20.

The demountable wall system 10 is typically interconnected between other wall structures. To assist in supporting the demountable wall system 10 and to actually connect the wall system 10 to an adjacent wall structure, there is provided a series of L-shaped brackets 22. As illustrated in the drawings, the L-shaped brackets 22 are connected to the ceiling strip 14*a* of the ceiling railing 14 and depend downwardly therefrom to where they connect by screws or other suitable means to an adjacent wall structure. It is appreciated that the portion of the L-shaped bracket 22 depending downwardly from the ceiling strip 14*a* can be disposed flush against an adjacent wall structure and secured directly into the adjacent wall structure by screws. Thus, typically the L-shaped brackets 22 are disposed on opposite ends of the demountable wall system 10 and will function to essentially interconnect the ceiling railing 14 with adjacent wall structures.

Secured within the demountable wall system 10 is a series of individual wall panels indicated generally by the numeral 24. As seen in FIG. 2, the wall panels 24 are secured on opposed sides of the demountable wall system 10. The individual walls panels can be constructed of various material such as gypsum, wood, plastic or other suitable materials. As seen in FIG. 1, each individual wall panel 24 includes a front face 24*a*, a back 24*b*, and a pair of side edges 24*c*. Each wall panel 24 further includes a pre-applied wall covering 24*d*. Note in FIGS. 1 and 4 where the pre-applied wall covering 24*d* is only disposed on a generally central portion of the front face 24*a* of the wall panel 24. Although the pre-applied wall covering 24*d* does extend from top to bottom, its sides terminate short of the side edges 24*c*. This leaves two uncovered areas or strips that run the entire length of the wall panel that as disposed outwardly of the pre-applied wall covering 24*d*.

Figure 3:
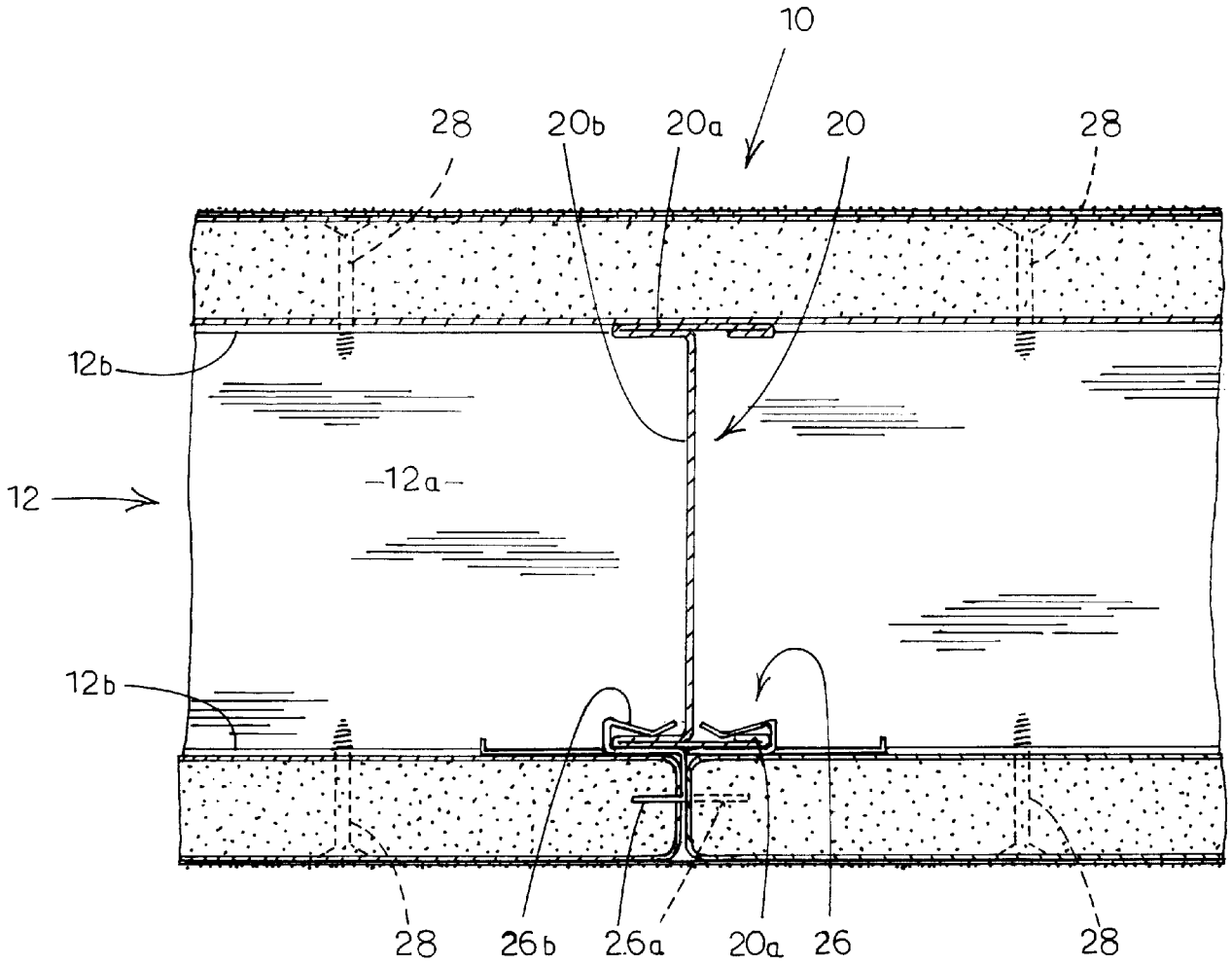
FIG. 3 is a fragmentary longitudinal sectional view through the demountable wall system of the present invention.

As seen in the drawings, the respective wall panels 24 are secured within the demountable wall system 10 side edge to side edge. To actually support the individual wall panels 24 within the wall system, there is provided a plurality of connector clips 26 that act to directly connect individual wall panels 24 to an adjacent wall stud 20. Note as shown in FIGS. 1, 2 and 3 that each connector clip 26 includes a pair of vertically spaced spikes 26*a* and a pair of retaining clips 26*b*. Note that the spikes 26*a* are driven into the side edge 24*c* of a respective wall panel 24 while the clips 26*b* are clipped onto the adjacent side railing 20*a* of a wall stud 20. This is particularly illustrated in FIG. 3. The number of connector clips 26 anchored into each respective edge may vary and may be vertically spaced along the height of the wall panel. In addition, as illustrated in FIG. 3, the connector clips 26 can be disposed in back-to-back relationship at the interface 34 of adjoining side edges 24*c* to wall panels 24. Because the side railing 20*a* of each wall stud is in the form of an I-beam then it is seen how the clips 26*b* of two or more separate connector clips 26 can be secured to the same wall stud 20.

In addition, the respective wall panels 24 are secured to the floor railing 12. As indicated in FIG. 2, a series of wall panel screws 28 are secured through the respective wall panels and into the legs 12*b* of the floor channel 12. To support the wall panels 24 at the top, it is seen that the respective wall panels are urged and contained between the legs 14*b* and the flanges 14*d* that project downwardly from the ceiling strip 14*a*. More particularly, the respective panels about the top are confined between the contact rails 14*c* and the lower portions of the depending flanges 14*d*. Thus, the respective wall panels 24 are stabilized at both their lower and upper portions.

Figure 4:
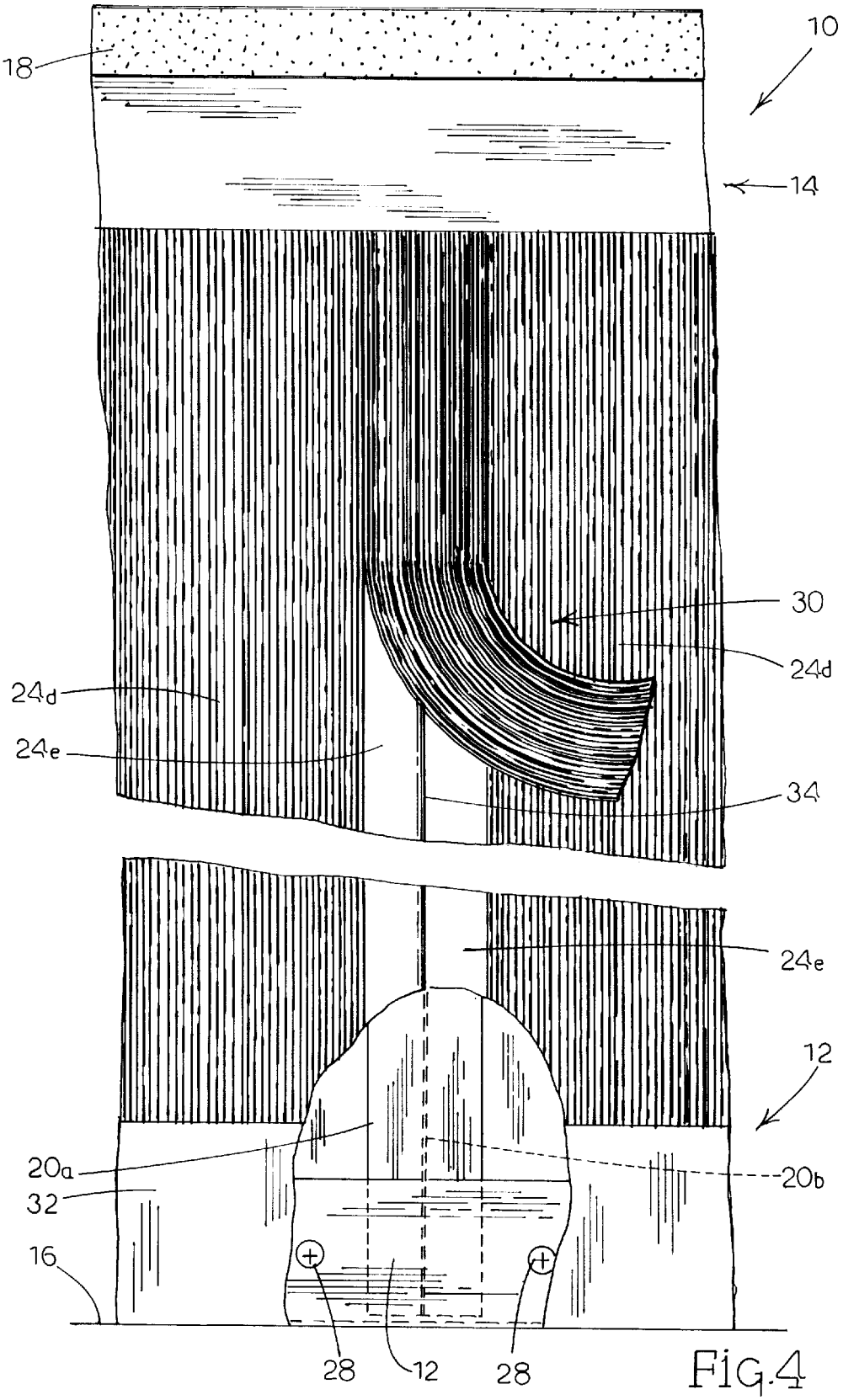
FIG. 4 is a fragmentary side elevational view of a portion of the demountable wall system showing the application of the wall covering filler strip that is used to cover the seam formed by the respective wall panels being placed edge to edge within the wall system.

Once the respective wall panels have been securely fixed and anchored within the demountable wall system 10, it is appreciated that they will be generally longitudinally aligned and will abut together where the side edges 24*c* come together. This will, of course, form a seam and, as indicated in FIG. 4, adjacent the formed seam or interface 34 between the respective wall panels 24 there will lie the uncovered areas or strips 24*e*.

To cover the seam or interface 34 between the respective panels and to fill the gap between the pre-applied wall coverings 24*d*, there is provided a series of wall covering filler strips indicated generally by the numeral 30. The wall covering filler strips 30 may be pre-cut into individual lengths or could be in the form of a roll and cut to order. But in any event, they would include a peel off backing that would expose an adhesive surface that would glue or stick directly to the uncovered areas 24*e* left on the front face 24*a* of the respective wall panels. Thus an installer would, as suggested in FIG. 4, align and abut the top edge of the filler strip underneath the contact rail 14*c* of the ceiling railing 14. Thereafter, the wall covering filler strip 30 would be aligned with the interface 34 between the respective panels and would be pressed and adhered to the uncovered areas or strips 24*e* that exist on the front face 24*a* of the respective panels. While doing this, the installer is careful to make sure that the side edges of the filler strip 30 are laid directly and closely adjacent the terminal edge of the pre-applied wall covering 24*d*. Of course, the wall covering filler strip 30 would preferably match or be coordinated with the pre-applied wall covering 24*d* so as to form an aesthetically pleasing appearance once the filler strip 30 is in place.

The demountable wall system of the present invention may be designed such that it includes exterior and interior corners. These corners will be formed by two adjacent wall panels abutting side-edge to side edge. Consequently, at the corners there will be formed a seam or interface. The same seam filler strip 30 can be used on both exterior and interior corners. In the case of an exterior corner, for example, the filler strip 30 can be adhered over the seam such that the sides of the filler strip are secured to uncovered areas of adjacent wall panels. The same process and technique would also be applied to interior corners.

After all of the seams and interfaces 34 have been filled along a selected segment of the wall system 10, then the wall system can be fitted with a molding strip 32 that would extend from the floor 16 a selected distance upwardly about the outer face of the panels. This molding strip 32 would hide the lower screws 32 and would protect the demountable wall system 10 about its base areas.

From the foregoing specification and discussion, it is appreciated that the present invention does indeed present a demountable wall system 10 that is capable of being suspended and connected to a ceiling structure 18 but yet can be disconnected therefrom and moved from one location to another within a building. At the same time, the present invention entails a wall system that includes a seamless side wall structure that presents a very aesthetically pleasing wall.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. A demountable wall system having seamless wall panels that is adapted to be mounted between ceiling and floor structures and which is further adapted to be readily movable from one location to another location between the floor and ceiling structures, comprising:

a) an elongated floor railing for resting adjacent the floor;

b) an elongated ceiling railing adapted to be disposed under and adjacent the ceiling;

c) ceiling connectors for interconnecting the ceiling railing with the ceiling, the ceiling connectors being disconnectable such that the ceiling railing and the demountable wall system can be moved from one location to another relative to the ceiling;

d) a series of spaced apart upright wall studs mounted between the floor and ceiling railings;

e) a series of wall panels secured between the ceiling and floor railings and connected to the wall studs;

f) each wall panel including face and back areas, opposed side edges, and an exterior wall covering secured to a central portion of the face area so as to define a pair of uncovered areas on opposite sides of the exterior wall covering such that when the walls are disposed edge to edge within the demountable wall system a seam is defined between the respective wall panels and flanking the seam is an uncovered area on each side of the seam; and g) a wall covering seam filler strip having an adhesive backing that is secured over the seam and covers both the seam and the two uncovered areas on the sides of the seam such that when the wall panels are aligned edge to edge they include a continuous and seamless wall covering.

2. A demountable wall system having seamless wall panels adapted to be mounted between a ceiling and floor structure comprising:

a) an elongated floor railing adapted to be disposed adjacent to the floor structure;

b) an elongated ceiling railing adapted to be disposed under and adjacent to the ceiling;

c) a series of disconnectable fasteners interconnecting the ceiling railing to the ceiling structure in order that the fasteners can be removed and disconnected such that the ceiling railing and the demountable wall system can be moved from one location to another with respect to the ceiling;

d) a series of spaced apart upright wall studs mounted between the floor and ceiling railings;

e) a series of wall panels secured between the ceiling and floor railings;

f) each wall panel including a front face area, a back face, opposed side edges, a pre-applied exterior wall covering disposed over a central portion of the face area of the panel so as to define a pair of uncovered areas on each side thereof;

g) the wall panels being mounted side edge to side edge within the demountable wall system such that a seam is defined along the interface between the respective side edges and wherein the uncovered areas about the face of the wall panels are disposed on opposite sides of the defined seam; and h) a wall covering seam filler strip extending vertically over respective defined seams so as to cover the same and extend over to the uncovered areas of the adjacent wall panels so as to cover the same and to form, in combination with the preapplied exterior covering, a continuous and seamless wall covering.

3. A method of erecting a demountable and movable wall system between ceiling and a floor structures comprising:

a) disposing a floor railing adjacent to the floor structure;

b) detachably securing a ceiling railing to the ceiling;

c) interconnecting a series of spaced apart wall studs between the floor railing and the ceiling railing;

d) forming a series of wall panels with each wall panel having a front face, back, opposite side edges, and a pre-applied wall covering that is disposed on a central portion of the face of the wall panel, leaving two uncovered areas on each side thereof with each uncovered area lying between one side edge of the wall panel and an edge of the preapplied wall covering;

e) after forming the wall panels, mounting the wall panels within the demountable wall system such that the wall panels are disposed side edge to side edge and extend generally between the floor railing and the ceiling railing and wherein there is formed a seam that is defined at the interface between the respective wall panels; and f) after the wall panels have been mounted within the demountable wall system, applying a wall covering seam filler strip over the defined seam extending at the interface of the respective panels and spreading the wall covering seam filler strip outwardly to where it covers the adjacent uncovered areas that exist on the two panels disposed opposite the seam and interface.

4. The method of claim 3 wherein the wall covering seam filler strips fill the uncovered areas of the faces of the wall panels such that there is a continuous wall covering applied to the faces of the consecutive wall panels and that the original seams defined at the interfaces of the wall panels are covered so as to form a continuous and seamless covered wall structure.

5. The method of claim 4 wherein the individual wall panels are secured to respective wall studs by a clip connector that includes at least one spike that inserts into one side edge of the panel and a connector for connecting to the wall stud.

6. The method of claim 3 including the step of moving the entire demountable wall system from one location to another by detaching the ceiling railing from the ceiling structure and moving the entire demountable wall system to a different location and then reattaching the ceiling railing to the ceiling structure.

7. The method of claim 3 wherein the wall covering seam filler strips include a peel-off adhesive backing that enables the wall covering seam filler strip to be secured directly to the face of the respective wall panels.

* * * * *